United States Patent [19]

Kigawa et al.

[11] Patent Number: 4,523,752

[45] Date of Patent: Jun. 18, 1985

[54] ORIGINAL DOCUMENT INSERTING DEVICE FOR COPYING APPARATUS

[75] Inventors: Shuji Kigawa; Eiji Otake, both of Hachioji, Japan

[73] Assignee: Konishiroku Photo Industry Co., Ltd., Tokyo, Japan

[21] Appl. No.: 513,785

[22] Filed: Jul. 15, 1983

Related U.S. Application Data

[63] Continuation of Ser. No. 169,147, Jul. 15, 1980, abandoned.

[30] Foreign Application Priority Data

Jul. 23, 1979 [JP] Japan ..... 54-92669

[51] Int. Cl.[3] ..... B65H 3/44

[52] U.S. Cl. ..... 271/9; 271/265; 355/14 SH

[58] Field of Search ..... 271/9, 265; 355/14 SH

[56] References Cited

U.S. PATENT DOCUMENTS

| | | | |
|---|---|---|---|
| 3,598,396 | 8/1971 | Andrews | 271/9 |
| 3,762,813 | 10/1973 | Fowlie | 355/14 SH |
| 3,817,515 | 6/1974 | Kanda | 271/9 |
| 3,820,777 | 6/1974 | Reehil | 271/9 X |
| 4,062,533 | 12/1977 | Greenberg | 271/9 X |
| 4,192,607 | 3/1980 | Hage | 271/9 X |

*Primary Examiner*—Richard A. Schacher

*Attorney, Agent, or Firm*—Jordan B. Bierman

[57] ABSTRACT

An apparatus is provided for successive copying of documents stacked on an automatic feeder or individual documents fed through a discretionary feed. Insertion of a document into the discretionary feeder temporarily halts feeding from the stack by the automatic feeder.

5 Claims, 3 Drawing Figures

ORIGINAL DOCUMENT INSERTING DEVICE FOR COPYING APPARATUS

This application is a continuation, of application Ser. No. 169,147, filed July 15, 1980, now abandoned.

BACKGROUND OF THE INVENTION

1. Field of the Invention

The present invention relates to an improved original document inserting device for copying apparatus provided with original feeding system conveying originals to the projection station.

2. Description of the Prior Art

There has heretofore been known an original document inserting device wherein each time when an original is inserted in feed means by hand, the feed means brings the original to original feeding system by which the original is conveyed to the projection station or a copy board. Another original doucment inserting device has also been known which has atuomatic feed means which feeds automatically originals one after another from the stack thereof to original feeding system, which conveys the originals to the projection station such as described above. The former device is well known in U.S. Pat. No. 4,023,791 and the latter device is well known in U.S. Pat. No. 3,747,918. Copying apparatus provided with the former device only has the advantage of enabling the feed of originals in any descretionary order, but its trouble of having to feed originals manually one by one reduces the efficiency of copying work, whereas one provided with the latter only has the advantage of permitting highly efficient copying work in the case of the feed of originals in stacked order, but when a copy of a different original is desired in its course, troublesome steps are needed such as removing the stack of originals, or temporarily stopping the automatic transport means to manually place the original onto the projection station without using original feeding system.

SUMMARY OF THE INVENTION

An object of the present invention is to provide an original document inserting device which has improved in removing such conventional disadvantages as mentioned above by designing so that the original inserting device is provided with two or more original document feed means bringing original one after another to original feeding system which conveys the originals to the projection station, so that when necessary any desired originals can be brought to original feeding system.

The above object, novel features and advantages of the invention will become more apparent from detailed description of the preferred embodiment thereof taken in conjunction with the accompanying drawings.

DETAILED DESCRIPTION OF THE PREFERRED EMBODIMENT

Figure 1:
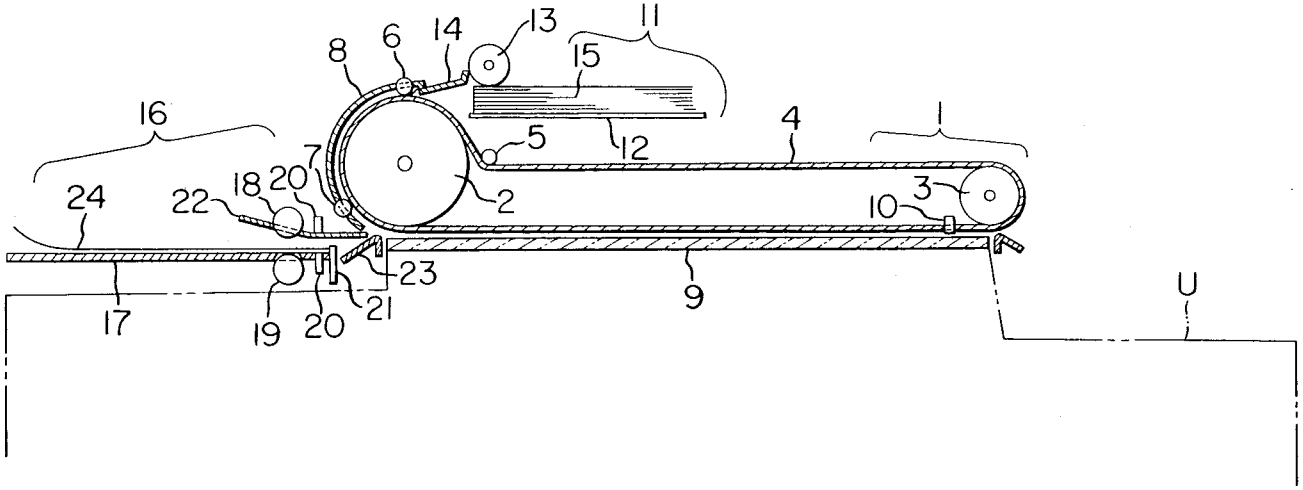
FIG. 1 is a side view showing an example of the constitution of the device according to the present invention.

In FIG. 1, reference number 1 is original feeding system composed of drive roller 2, driven roller 3, transport means 4 which consists of a plurality of parallel spaced endless belts, tension roller 5, guide rollers 6 and 7, and guide member 8 attached thereto. Drive roller 2, driven roller 3, endless belts, tension roller 5, and guide rollers 6 and 7 are made of rubber. 9 is a copy board made of glass in the projection station (no reference symbol). 10 is a detector for detecting the front end of an original document. The detector is provided at a predetermined position in gap formed between the endless belts. The detector 10 is, for example, a photo sensor consists of light emitting element and light receiving element. And the signal from the detector 10 enters in a control circuit illustrated in FIG. 2. A gap between a copy board 9 and the lower surface of the belt which is adjacent to the copy board is exaggerated for ease of understanding FIG. 1. 11 denotes an automatic feed means composed mainly of a base 12 for originals to be copied and stacked, which is pressed upward by spring means or the like (not shown) so that the top of a stack of originals may be in contact with automatic feed roller 13; a detector for detecting the presence of an original (not shown); feed roller 13 of the automatic feed means 11 for feeding of originals one by one with its rotation and friction force between the roller 13 and stacked originals; and guide member 14 placed between the guide member 8 and driven roller 13. 15 is originals stacked on a base 12 for originals to be copied. 12 is actually supported by frame device (not shown) of the feed means 11. U with a imaginary line is a recording apparatus such as electrophotographic copying machine (referred to as copier hereinafter). Detailed construction of the copier is not figured, because it doesn't concern this invention. 16 is a discretionary feed means provided with feed base 17 fixed to copier U; a pair of upper and lower feed rollers 18 and 19; feed detecting means 20; stopper 21; and upper and lower guide member 22 and 23. Stopper 21 is for regulating the front edge of original 24 so as to make the edge aligned to the discretionary feed member 16. 24 is an original discretionary fed one by one into the feed means by feed rollers 18 and 19 when desired.

Figure 2:
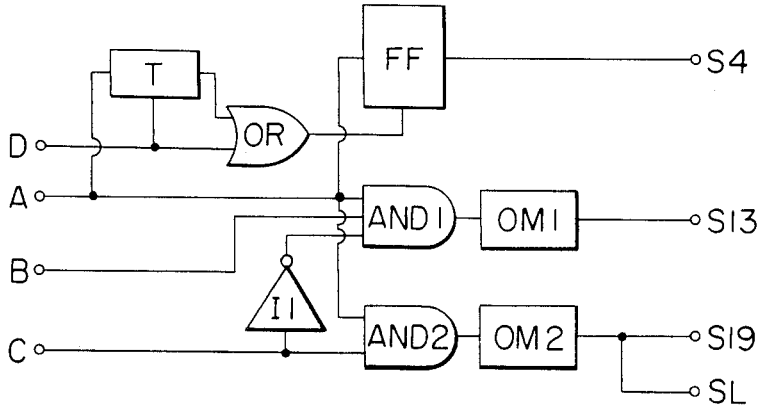
FIG. 2 is a block diagram of the control circuit which controls to permit automatic interruption of an automatic feed means, when a desired original is inserted into a discretionary feed means.

Next, the operation of the device thus constituted is described below by making use of FIG. 2 and FIG. 3.

The copying apparatus is now set so that one copy sheet is made from one original document and a stack of originals 15 is loaded onto the base 12 of automatic feed means 11, and then when the copying button (not shown) is depressed, the first electric signal SA is produced and entered in original exchange signal terminal A, which signal output is provided to AND gate AND 1 together with original presence signal SB which is entered in original presence signal terminal B from the original presence detector (not shown) of automatic feed means 11 and with interruptive signal SC which is provided to interruptive signal terminal C from detecting means 20 mentioned hereinbefore, and then inverted by invertor I 1. When there is a stack of originals 15 on the base 12, the original presence signal SB is on a higher level than pre-selected reference level and if not so it is on a lower level. And when the detecting means 20 detects an original, the interruptive signal SC is on a higher level than pre-selected level and if it does't, the signal SC is on lower level. The original exchange signal SA ia further entered in AND gate AND 2 and in the trigger terminal of trigger flip flop circuit FF. The interruptive signal SC which is entered in the interruptive signal terminal C is further entered in AND gate AND 2. AND gate AND 1 produces on electric output signal S13 for driving the feed roller 13 of automatic feed means 11 through one-shot multivibrator OM1 (referred as to OM1, merely, hereinafter) which is reset after a definite lapse of time. Trigger flip flop circuit FF provides signal output S4 for driving of the belt of original feeding system 1. AND gate AND 2 provides electric output signal S19 for interrupting the drive of the roller 19 through one-shot multivibrator OM2 (referred to as OM2, merely, hereinafter) which is reset after a definite lapse of time and electric signal SL for generating a solenoid (not shown) which lowers both stopper 21 and upward-feed roller 18. Therefore, the pulse of electric signal SA for exchanging original is provided for original exchange signal terminal A under such conditions that on the base 12 of automatic feed means 11 stack of originals 15 is loaded, while descretionary feed means 16 is not supplied with original 24, AND gate AND 1 then provides similar trigger pulse as output signal to OM 1 to render it provide output signal S13, as shown in FIG. 3, so that feed roller 13 rotates to feed an original from automatic feed means 11 to original feeding system 1. At the same time the pulse of the original exchange signal causes FF to provide output signal S4 for driving the belt of drive original feeding system 1, so that the original brought from automatic feed means 11 is to be conveyed by original feeding system 1, and in the stage of the conveyed original remaining between guide roller 6 and belt 4 and still being in contact with automatic feed roller 13, the rotation of the roller 13 becomes passive (i.e., becomes rotated by the conveyed original) by signal S13 which turns to be on a lower level. As OM 1 is reset after a definite lapse of time, at same time, electric signal S13 turns to be on a lower lever. And, AND gate AND 2 does not provide trigger signal output even when the pulse of the original exchange signal is entered therein because the interruptive signal is on a lower level, and thus the means involved discrationary feed means 16 do not work.

Figure 3:
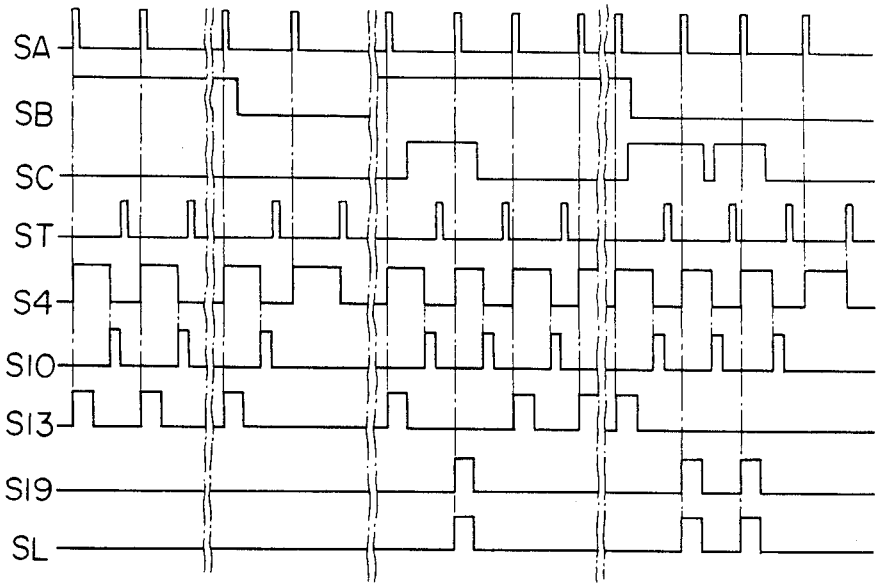
FIG. 3 is a time chart for various signals in the circuit shown in FIG. 2.

When the front end of the original conveyed by transport means or belts 4 reaches to a position where the detector 10 is prepared, the detector 10 provides output signal of detecting the front end of the original S10, as shown in FIG. 3, to original detection signal terminal D. Signal S10 is entered in the reset terminal of trigger flip flop circuit FF through OR gate, and the pulse of the signal S10 switches output signal S4 of FF to stop the drive of original feeding system 1, thus stopping the original in the given position on the copy board 9 or the position for projection. The original is stopped on the copy board 9 through impingement with a stopper not shown in FIG. 1 and such a stopper is disclosed, for example in U.S. Pat. No. 4,023,791. Upon the stop of the original in the projection station, copying of the original by projection is made in a known manner, and then without depressing the copying button, from the copier to original exchange signal terminal A, the pulse of original exchange signal SA is given to cause automatic feed means 11 and original feeding system 1 to drive again to feed subsequent original from the automatic feed means and simultaneously to perform the delivery of the copying-completed original and the receiving of subsequent original fed by the original feeding system. The copying-completed original is carried out to on original receiving tray which is not shown in FIG. 1.

By the repetition of the above, stacked originals 15 are fed one after another to original feeding system 1 to be copied. When the copying of the last original is carried out, and consequently the pulse of original exchange signal SA is given by the copier, AND gate AND 1 does not provide trigger signal output on OM 1 because the input signal from original presence signal terminal B is already on a lower level, and thus, without the drive of automatic feed means 11, original feeding sytem 1 alone is driven by signal S4 of FF to deliver the copying-completed original. The drive of original feeding system 1 at this time stopped by the input of the foregoing pulse of the original exchange signal to FF through timer T and OR gate after the last original is exhausted out of the original feeding system. The period of operation time of timer T here is set to be longer than that, as shown in the timer output signal ST in FIG. 3, from the beginning of the drive of original feeding system 1 by FF according to the pulse of original exchange signal S10 after the conveyance of the original to the position for projection. Consequently, in the case of the successive feed of originals for reproduction, the reset of FF performed through timer T and OR gate by the pulse of original exchange signal SA has no influence upon belt drive signal S4 because said reset is preceded by the reset made by signal S10 of detecting the front end of the original.

Then, the feed of an original into discretionary feed means 16 made in the midst of feeding originals from automatic feed means 11 is described below.

When supplying an original 24 to discretionary feed means 16, and inserting it into detecting means 20, in the detecting means 20, interruptive signal SC which is on a higher level is entered in interruptive signal terminal C to cause AND gate AND 1 not to provide trigger signal output, while AND gate AND 2 is subjected to the pulse of the original exchange signal to become able to provide trigger signal output. Upon the completion of copying the original already brought from automatic feed means 11, as previously mentioned, a pulse is entered in original exchange signal terminal A from the copier at regular intervals, so that AND gate AND 2 provides trigger signal output to OM 2 to render it provide both signal outputs S19 for driving the roller 19 and signal output SL for driving a solenoid (not shown), thereby to rotate downward-feed roller 19 and to lower both upward-feed roller 18 and stopper 21, thus feeding original 24 from discretionary feed means 16. It should be understood that the detecting means is operating condition as for as a main switch (not shown) for machine is turned on, in this embodiment. Since, at the same time, the pulse of original exchange signal SA renders flip-flop circuit FF drive original feeding system 1, so that the delivery of the copying-completed original and the receiving of subsequent original 24 by original feeding system 1 are performed, and thereafter the copying of the subsequent one is made in a similar manner to the case of the infeed from automatic feed means 11. If a subsequent original is further fed into discretionary feed means 16 before the completion of the copying of original 24, the reproduction of the subsequent original is made in succession to the completion of the preceding original's copying, while if no subsequent original is fed into discretionary feed means 16, the copying of originals from automatic feed means 11 is to be resumed. When the stack of originals 15 on automatic feed means 11 run out, original 24 fed in from discretionary feed means 16 is also delivered, as in the case of the last original from automatic feed means 11, by original feeding system 1 after the copying of the original is made by the action of timer T, and then original feeding system 1 is stopped.

If discretionary feed means 16 alone is to be employed without using automatic feed means 11, either the output circuit of AND gate AND 1 or of OM 1 should be adapted to be open. Thus, even when a stack of originals 15 is loaded on the base 12 of the automatic feed means, the copying of the original from the discretionary feed means can be made in an already mentioned manner by supplying discretionary feed means 16 with an original and depressing the copying button.

According to the present invention, as has been mentioned, both copying by the automatic feed in succession and copying singly by the manual feed are achievable; such an excellent effect is attainable that without waiting until the stack of originals run out, or without such trouble as removing the stack of originals or the insertion of an original without through transport means, any desired singly copying can be made whenever necessary in the midst of automatic feed copying operation.

The present invention is not limited to the aforementioned example. Original inserting device for copying apparatus of this invention may be such that the copying button for the automatic feed means and the copying button for the discretionary feed means are separately provided, and by depressing either of them the feed switching is manually carried out. In addition, as described in the claims, if a plurality of automatic original feed means or a plurality of discretionary original feed means are provided each of which is put in priority order, or if a selective means is provided for the selection of original feed means, there would be such a great advantage that a number of different kinds of originals are allowed to be set at a time, so that any desired original can be reproduced at any time when necessary without moving other set originals.

What is claimed is:

1. An original document feeding device to be used for a copying apparatus, comprising:

(a) automatic feed means for successively feeding the uppermost one of original documents stacked face up on a base;

(b) alternate feed means for individually feeding an original document inserted therein;

(c) transport means for conveying each fed original document to a projection station for copying and for discharging a previous original document at said projection station;

(d) an automatic copy actuator for providing a series of signals for operating successive copying cycles of said copying apparatus;

(e) an alternate feed detector for providing an interrupt signal upon detection of an original document inserted in said alternate feed means;

(f) a copy position detector for detecting the position of an original document transported by said transport means to said projection station;

(g) first circuit means responsive to said signals of said actuator for successively actuating said automatic feed means, and responsive to an interrupt signal of said alternate feed detector to interrupt actuation of said automatic feed means and actuate said alternate feed means in priority over said automatic feed means; and (h) second circuit means responsive to said signals of said actuator for successively actuating said transport means, and responsive to said copy position detector for stopping said transport means upon transport of each original document to said projection station for copying, whereby successive cycles of copying from said stacked original documents are automatically effected and said successive cycles may be interrupted at any point for copying an individually inserted original document.

2. The original document feeding device of claim 1, wherein said second circuit means includes a timer set in response to a signal of said automatic copy actuator for providing a timing signal after a period of time longer than a transporting cycle of said transport means, in order to stop said transport means after discharge of a last original document from said projection station.

3. The original document feeding device of claim 1, wherein said automatic feed means includes a document presence detector for preventing actuation of said automatic feed means upon detecting the absence of original documents on said base.

4. The original document feeding device of claim 1, wherein said alternate feed means includes a movable feed roller and a document position stopper in a feed path of said alternate feed means, and further wherein said second circuit means includes means for actuating said feed roller and moving said document position stopper out of the feed path of said alternate feed means.

5. The original document feeding device of claim 1, wherein said first and second circuit means each includes an AND gate, said interrupt signal being directly provided to said AND gate of said second circuit means, and being provided to said AND gate of said first circuit means through an inverter.

* * * * *